US010172393B2

(12) United States Patent
Li et al.

(10) Patent No.: US 10,172,393 B2
(45) Date of Patent: Jan. 8, 2019

(54) HEATING DEVICE, ATOMIZING UNIT, ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Shuyun Hu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/487,432

(22) Filed: Apr. 13, 2017

(65) Prior Publication Data

US 2017/0215481 A1 Aug. 3, 2017

(30) Foreign Application Priority Data

Apr. 21, 2016 (CN) ..... 2016 1 0249406

(51) Int. Cl.
*A24F 47/00* (2006.01)
*H05B 3/42* (2006.01)

(52) U.S. Cl.
CPC ..... *A24F 47/008* (2013.01); *H05B 3/42* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 5,179,966 | A * | 1/1993 | Losee | A24F 47/008 128/202.21 |
| 2014/0346689 | A1* | 11/2014 | Dubief | A24F 47/008 261/142 |
| 2015/0335073 | A1* | 11/2015 | Li | A24F 47/008 131/329 |
| 2016/0021930 | A1* | 1/2016 | Minskoff | A61M 15/06 131/329 |
| 2016/0135505 | A1* | 5/2016 | Li | H05B 3/44 131/329 |
| 2016/0309786 | A1* | 10/2016 | Holtz | F22B 1/284 |
| 2016/0316819 | A1* | 11/2016 | Zhou | A24F 47/008 |
| 2016/0338413 | A1* | 11/2016 | Li | A24F 47/008 |
| 2017/0035116 | A1* | 2/2017 | Batista | A24F 47/008 |
| 2017/0127722 | A1* | 5/2017 | Davis | H05B 6/108 |
| 2017/0215481 | A1* | 8/2017 | Li | A24F 47/008 |
| 2017/0367402 | A1* | 12/2017 | Lau | A24F 47/008 |
| 2018/0020723 | A1* | 1/2018 | Davis | A24F 47/008 |

* cited by examiner

*Primary Examiner* — James Harvey
(74) *Attorney, Agent, or Firm* — Cheng-Ju Chiang

(57) ABSTRACT

The present disclosure relates to a heating device for heating tobacco liquid. The heating device includes a heating element, and a liquid conducting body configured for guiding the tobacco liquid to the heating element. The liquid conducting body includes a main body and at least one liquid conducting arm extending from the main body. The heating element is inserted in the main body, and is integrally formed with the main body. The at least one liquid conducting arm and the main body are made of micro-porous material.

14 Claims, 8 Drawing Sheets

HEATING DEVICE, ATOMIZING UNIT, ATOMIZER AND ELECTRONIC CIGARETTE HAVING SAME

TECHNICAL FIELD

The present invention relates to electronic cigarettes, and particularly to a heating device, an atomizing unit, an atomizer and an electronic cigarette using same.

BACKGROUND ART

A typical atomizer includes a liquid conducting body and a heating element in tight contact with the liquid conducting body. The heating element is configured for heating tobacco liquid in the liquid conducting body to form aerosol. However, a contact surface between the liquid conducting body/the heating element and other components is usually large. Accordingly, a large part of heat is lost due to thermal conduct. Therefore, efficiency of the atomizer may be low.

What are needed, therefore, are a heating device, an atomizing unit, an atomizer and an electronic cigarette using same, which can overcome the above shortcomings.

SUMMARY

The present disclosure relates to a heating device for heating tobacco liquid. The heating device includes a heating element, and a liquid conducting body configured for guiding the tobacco liquid to the heating element. The liquid conducting body includes a main body and at least one liquid conducting arm extending from the main body. The heating element is inserted in the main body, and is integrally formed with the main body. The at least one liquid conducting arm and the main body are made of micro-porous material.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
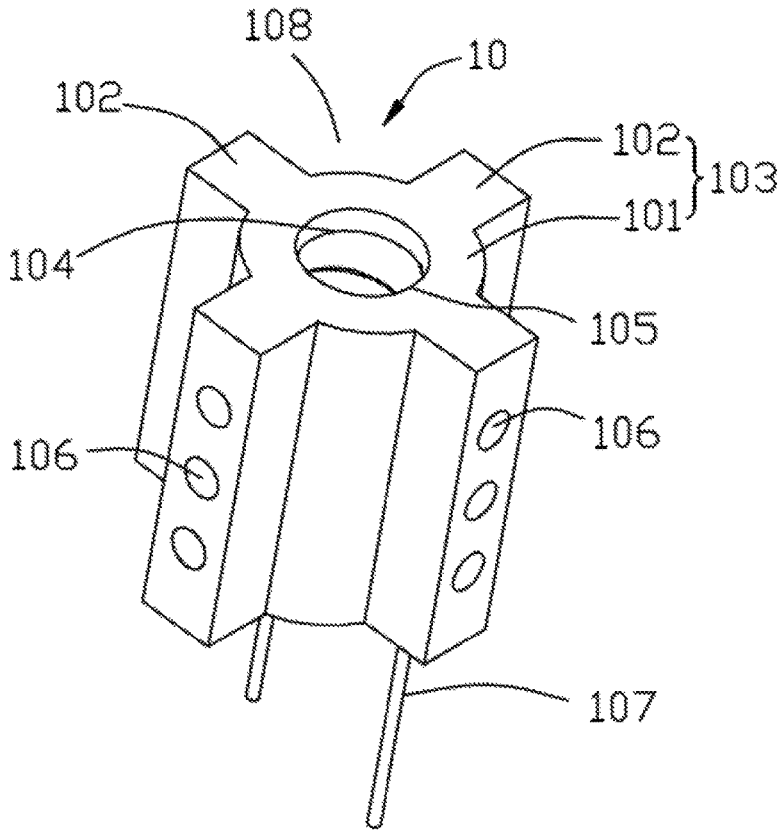
FIG. 1 is an isometric view of a heating device according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
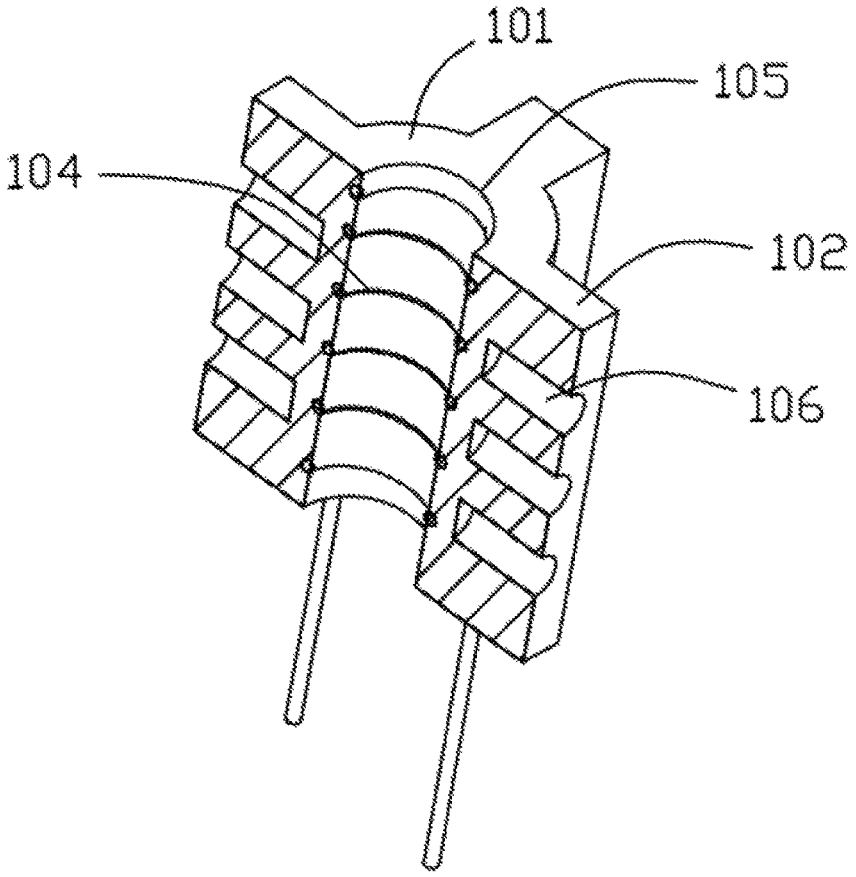
FIG. 2 is a partially cut-away view of the heating device of FIG. 1.

Referring to FIGS. 1-2, a tobacco liquid heating device 10 is provided. The heating device 10 is configured (i.e., structured and arranged) for heating tobacco liquid to form aerosol. The heating device 10 includes a heating element 104 and a liquid conducting body 103. The liquid conducting body 103 is configured for guiding the tobacco liquid to the heating element 104. The liquid conducting body 103 includes a main body 101 and at least one liquid conducting arm 102 extending outwardly from the main body 101. The liquid conducting arm 102 is in contact with the tobacco liquid. The heating element 104 is inserted in the main body 101, and is integrally formed with the main body 101. The main body 101 is substantially cylindrical, and a plurality of liquid conducting arms 102 extends from a side surface of the main body 101 radially. When the heating device 10 is assembled in an atomizer 30, only liquid conducting arms 102 contact with other components of the atomizer 30, thus reducing thermal loss. In the present embodiment, four liquid conducting arms 102 are evenly arranged around the main body 101. It is to be understood that, in other embodiments, a quantity of the liquid conducting arms 102 may be increased, with a gap between two adjacent liquid conducting arms 102. The liquid conducting arms 102 and the main body 101 are both made of micro-porous material. The tobacco liquid is conveyed to the heating element 104 for atomization through the liquid conducting arms 102 and the main body 101 via capillary action.

Quite usefully, the micro-porous material is micro-porous ceramic, the liquid conducting arms 102 and the main body 101 are integrally formed, and the heating element 104 is sintered together with the micro-porous ceramic and inserted into the main body 101. During sintering process, porefoaming agent is added. It is to be understood that, in other embodiments, the liquid conducting body 103 may be made of porous metal.

Quite usefully, the main body 101 centrally defines a first aerosol passage 105 extending through the main body 101, and the heating element 104 is arranged in the first aerosol passage 105. The heating element 104 is a spiral heating wire, and the heating wire is sintered on an inner surface of the main body 101. The heating wire is connected to electrodes of a power supply via two leads 107. The heating wire is configured for heating tobacco liquid permeating from the liquid conducting arms 102 and the main body 101 to form aerosol, which is expelled via the first aerosol passage 105. Alternatively, the heating element 104 may be a resistance layer or a metallic pattern formed on an internal surface of the main body 101. Further, the liquid conducting arms 102 defines a plurality of blind holes 106. The blind holes 106 increase increases a contact area between the liquid conducting arms 102 and the tobacco liquid, and enhances liquid conducting efficiency of the liquid conducting body 103. The blind holes 106 are not in direct communication with the first aerosol passage 105.

Figure 3:
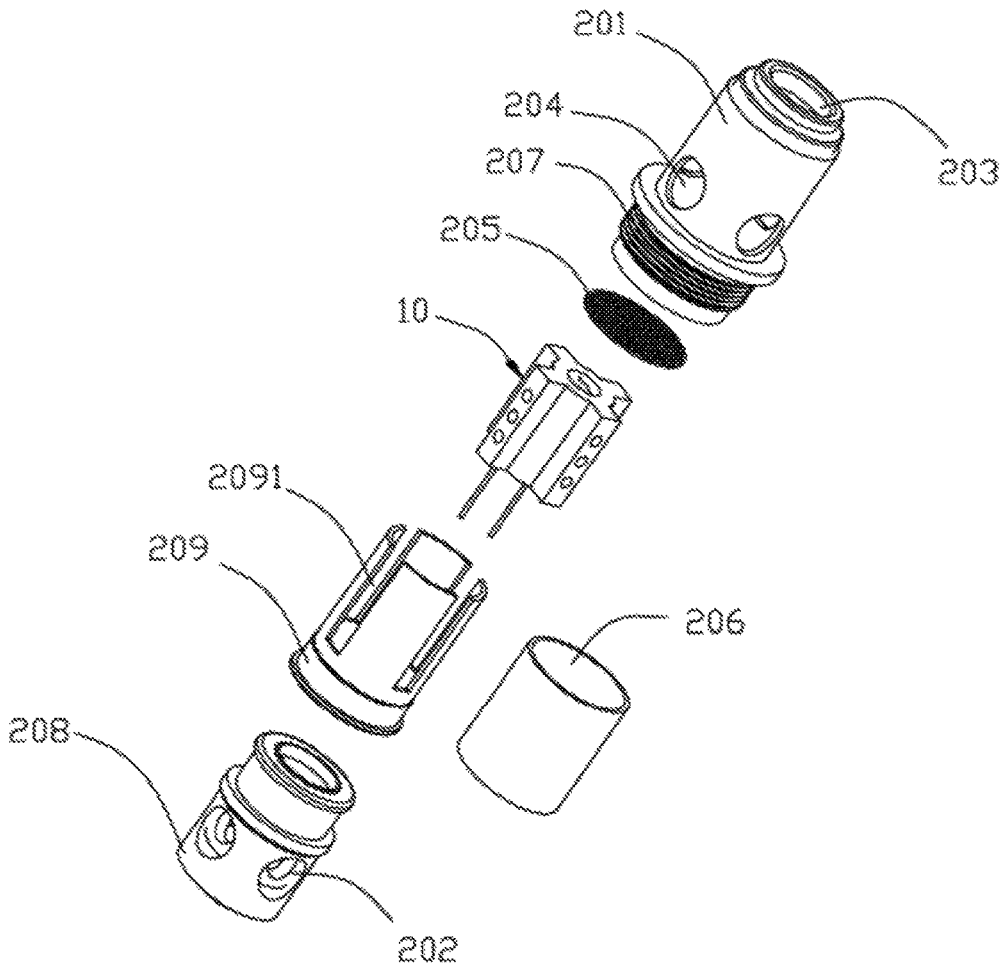
FIG. 3 is an exploded perspective view of an atomizing unit according to a second embodiment.
Figure 4:
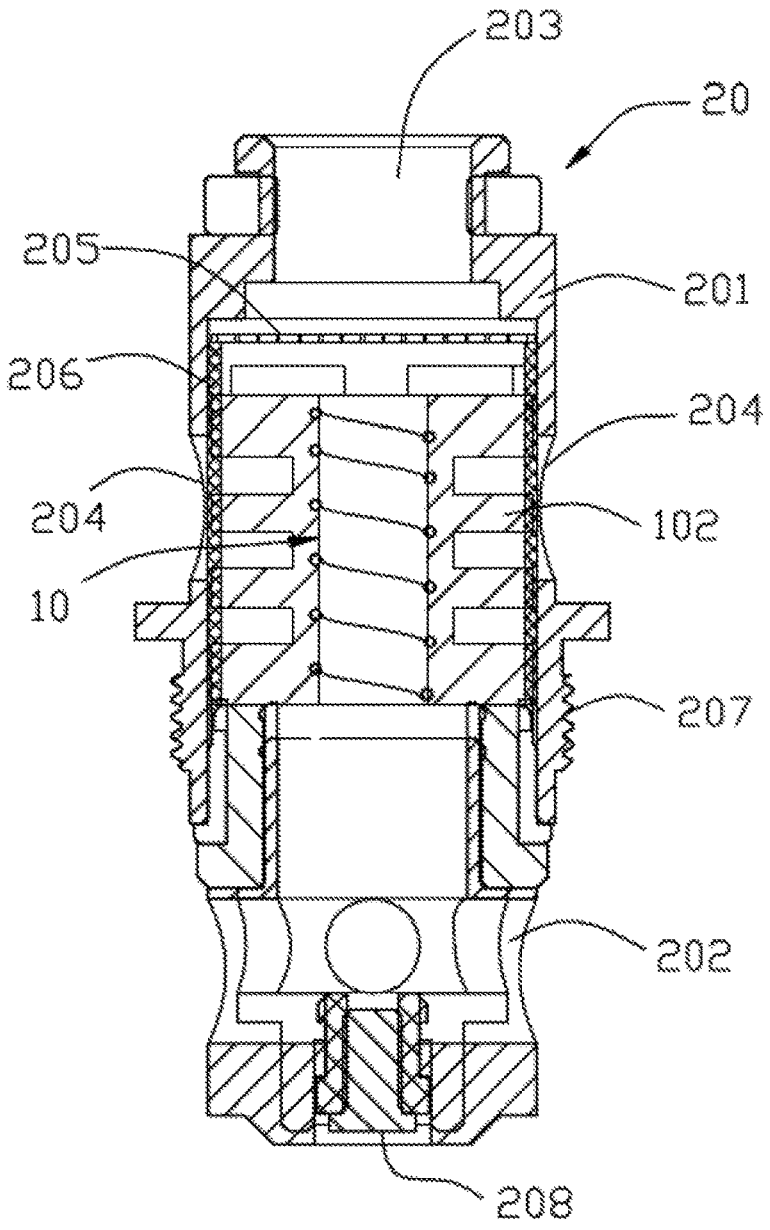
FIG. 4 is a longitudinal cross-sectional view of the atomizing unit of FIG. 3.
Figure 5:
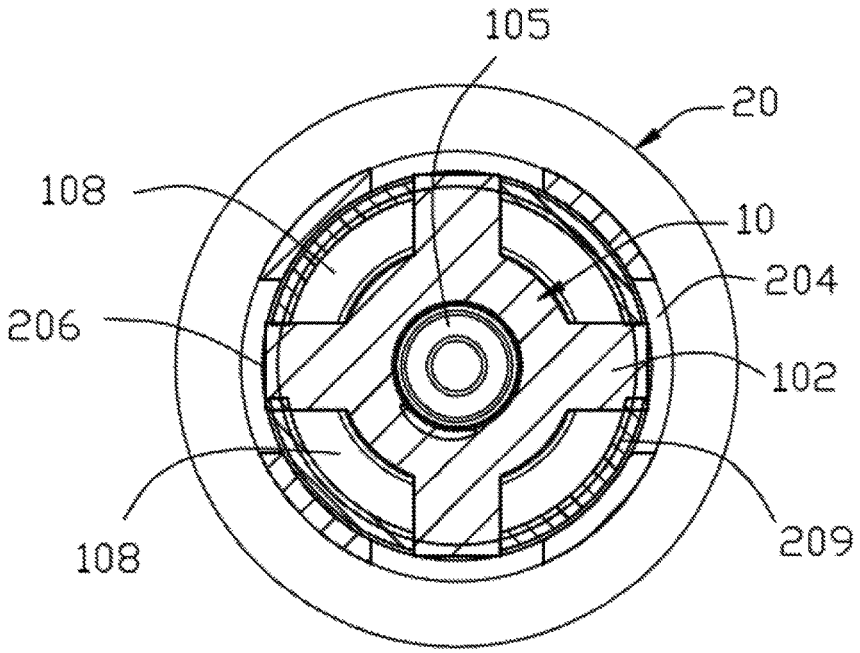
FIG. 5 is another cross-sectional view of the atomizing unit of FIG. 3.

Referring to FIGS. 3-5, a replaceable atomizing unit 20 including the heating device 10 is shown. The atomizing unit 20 includes a housing 201 and a heating device 10 arranged in the housing 201. The housing 201 is cylindrical, and defines an air inlet 202 and an air outlet 203 at two opposite ends. The heating device 10 is arranged between the air inlet 202 and the air outlet 203. A plurality of screw threads 207 are further provided on the housing 201, and configured for assembling in the atomizer 30. An electrical connection part 208 is further provided at a bottom end of the housing 201, and configured for connecting two leads 107 of the heating element 104. The housing 201 defines at least one liquid inlet 204. A quantity of the liquid inlets 204 is identical with that of the liquid conducting arms 102. The liquid conducting arms 102 are spatially corresponding to the liquid inlets 204. Two adjacent liquid conducting arms 102 define a second aerosol passage 108. Air incoming from the air inlet 202 enters the first aerosol passage 105, and then the air bringing the aerosol is expelled via the air outlet 203.

Referring to FIG. 3, a bracket 209 is further provided in the housing 201, and configured for assembling the heating device 10. The bracket 209 is fixedly connected in the housing 201. In the present embodiment, the bracket 209 defines four gaps 2091, a quantity of which is identical with that of the liquid conducting arms 102. The liquid conducting arms 102 are arranged in the gaps 2091, and each liquid conducting arm 102 extends out of the bracket 209 via the corresponding gap 2091.

Quite usefully, a liquid storing layer 206 is wrapped around the bracket 209, and is configured for absorbing tobacco liquid. Quite usefully, the liquid storing layer 106 is made of fiber cotton. The fiber cotton is arranged between the housing 201 and the bracket 209. The tobacco liquid goes in via the liquid inlet 204, and is then absorbed by the liquid storing layer 206. The liquid conducting arms 102 absorb the tobacco liquid from the liquid storing layer 206. The liquid storing layer 206 can buffer the tobacco liquid. Further, a filter net 205 is arranged between the heating device 10 and the air outlet 203. The filter net 205 is configured for preventing large liquid drops, which are not atomized adequately, from entering the mouthpiece.

Referring to FIG. 5, the heating device 10 is arranged in the housing 201, the main body 101 defines the first aerosol passage 105. Two adjacent liquid conducting arms 102, the main body 101 and the bracket 209 cooperatively define one of four second aerosol passages 108. Part of the aerosol generated by the heating element 104 is expelled from the first aerosol passage 105. Since the liquid conducting body 103 is porous, part of the aerosol permeates the main body 101 and the liquid conducting arms 102, and is expelled from the four second aerosol passages. Only part of the liquid conducting arms 102 is in contact with the bracket 209, and accordingly, thermal loss is decreased.

Figure 6:
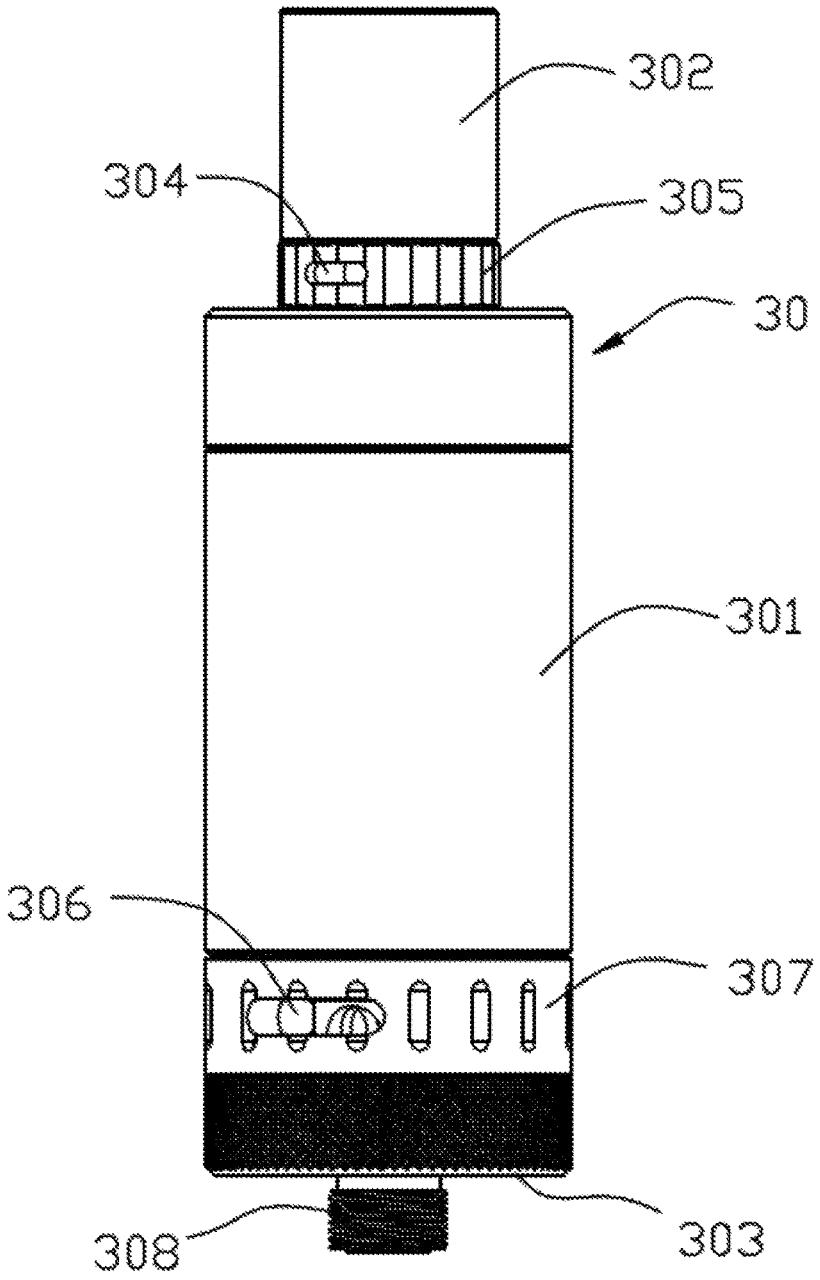
FIG. 6 is a side view of an atomizer according to a third embodiment.
Figure 7:
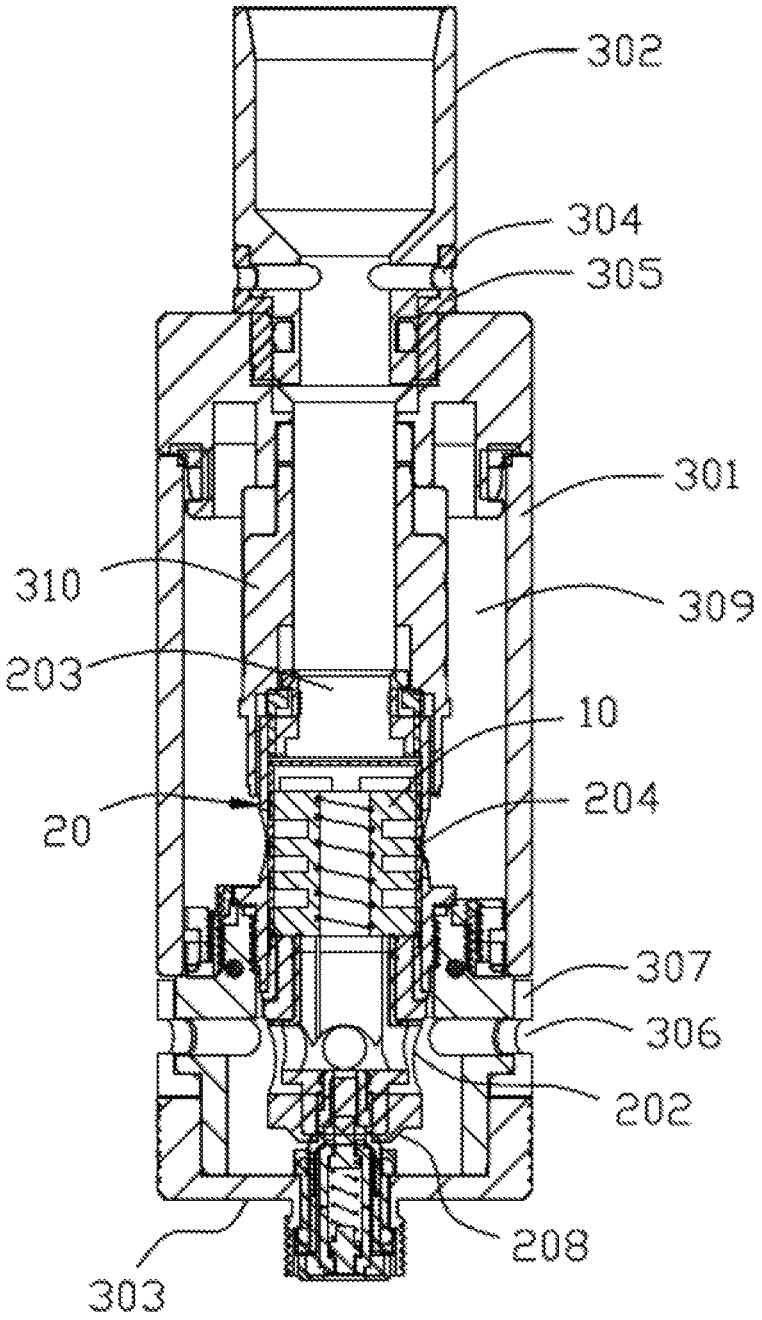
FIG. 7 is a longitudinal cross-sectional view of the atomizer of FIG. 6.

Referring to FIGS. 6-7, an atomizer 30 for an electronic cigarette 50 is shown. The atomizer 30 includes a shell 301 and the atomizing unit 20 is detachably assembled in the shell 301. The shell 301 defines a liquid chamber 309 for storing tobacco liquid. The liquid inlet 204 is in communication with the liquid chamber 309, so that the liquid conducting arms 102 can absorb the tobacco liquid in the liquid chamber 309.

In detail, a mouthpiece 302 is provided at an end of the shell 301, and an electrode assembly 303 is provided at an opposite end. The electrode assembly 303 includes a plurality of screws for connecting with a power supply 40. The electrode assembly 303 abuts against the electrical connection part 208 of the atomizing unit 20, thus achieving electrical connection with the heating element 104. An air pipe 310 is arranged in the shell 301, communicating the mouthpiece 302 and the air outlet 203 of the atomizing unit 20. The electrode assembly 303 and the atomizing unit 20 are detachably connected to the shell 301 via screw threads, thus sealing the liquid chamber 309. A top end of the atomizing unit 20 is coupled in the air pipe 310, and aerosol in the first and the second aerosol passage 105, 108 goes in the mouthpiece 302 via the air pipe 310.

Quite usefully, a first air inlet 306 and a first adjusting ring 307 are provided at an end of the atomizer 30 adjacent to the electrode assembly 303. The first adjusting ring 307 is configured for adjusting an air inflow of the first air inlet 306. The first air inlet 306 is in communication with the air inlet 202 of the atomizing unit 20. An amount of aerosol can be changed by adjusting the first adjusting ring 307.

A second air inlet 304 and a second adjusting ring 305 are provided at an end of the atomizer 30 adjacent to the mouthpiece 302. The second air inlet 304 is in communication with the mouthpiece 302. The second adjusting ring 305 is configured for adjusting an air inflow of the second air inlet 304. A concentration of the aerosol can be changed by adjusting the second adjusting ring 305.

Figure 8:
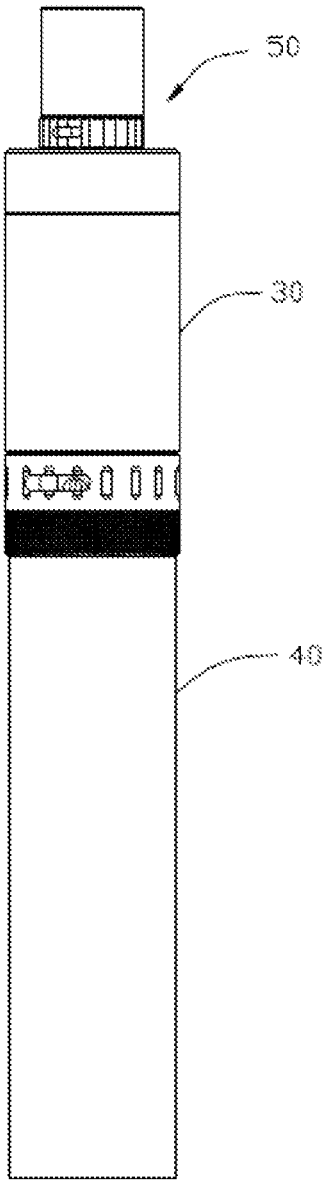
FIG. 8 is a side view of an electronic cigarette according to a fourth embodiment.

Referring to FIG. 8, an electronic cigarette 50 is shown. The electronic cigarette 50 includes the above-mentioned atomizer 30 and a power supply 40. The power supply 40 is configured for supplying the atomizer 30 power.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A heating device for heating tobacco liquid, comprising:

a heating element; and a liquid conducting body configured for guiding the tobacco liquid to the heating element;

wherein the liquid conducting body comprises a main body and at least one liquid conducting arm extending from the main body, the heating element is inserted in the main body, and is integrally formed with the main body, and the at least one liquid conducting arm and the main body are made of micro-porous material, the at least one liquid conducting arm defines a plurality of blind holes.

2. The heating device according to claim 1, wherein the main body defines a first aerosol passage extending therethrough, and the heating element is arranged in the first aerosol passage.

3. The heating device according to claim 2, wherein the heating element is integrally formed on an internal surface of the main body by sintering.

4. An atomizing unit, comprising:

a housing defining an air inlet and an air outlet at two opposite ends; and a heating device for heating tobacco liquid, the heating device being arranged in the housing, and comprising:

a heating element and a liquid conducting body configured for guiding the tobacco liquid to the heating element;

wherein the liquid conducting body comprises a main body and at least one liquid conducting arm extending from the main body, the heating element is inserted in the main body, and is integrally formed with the main body, and the at least one liquid conducting arm and the main body are made of micro-porous material;

wherein the housing defines at least one liquid inlet, the at least one liquid conducting arm is spatially corresponding to the at least one liquid inlet, and two adjacent liquid conducting arms cooperatively define a second aerosol passage.

5. The heating device according to claim 1, wherein the at least one liquid conducting arm and the main body are integrally formed by micro-porous ceramic.

6. An atomizer, comprising:

a shell defining a liquid chamber for containing tobacco liquid; and an atomizing unit according to claim 4, the atomizing unit being detachably arranged in the shell, the at least one liquid conducting arm being configured for absorbing the tobacco liquid in the liquid chamber.

7. The atomizing unit according to claim 4, further comprising a bracket in the housing, wherein the bracket is configured for fixing the heating device, the bracket defines at least one gap corresponding to the at least one liquid conducting arm, and the at least one liquid conducting arm extend out of the bracket via a corresponding gap.

8. The atomizing unit according to claim 7, further comprising a liquid storing layer wrapping around the bracket.

9. The atomizing unit according to claim 4, further comprising a filter net arranged between the heating device and the air outlet.

10. An electronic cigarette, comprising:

an atomizer according to claim 6; and a power supply connected to the atomizer, the power supply being configured for feeding the atomizer power.

11. The atomizer according to claim 6, further comprising a mouthpiece at a first end of the atomizer, and an electrode assembly at an opposite second end of the atomizer, wherein the electrode assembly is electrically connected with the heating element.

12. The atomizer according to claim 11, further comprising an air pipe in the shell, wherein the air pipe communicates the mouthpiece and the air outlet of the atomizing unit.

13. The atomizer according to claim 11, further comprising a first air inlet and a first adjusting ring at an end of the atomizer adjacent to the electrode assembly, wherein the first adjusting ring is configured for adjusting an air inflow of the first air inlet, and the first air inlet is in communication with the air inlet of the atomizing unit.

14. The atomizer according to claim 11, further comprising a second air inlet and a second adjusting ring at an end of the atomizer adjacent to the mouthpiece, wherein the second air inlet is in communication with the mouthpiece, and the second adjusting ring is configured for adjusting an air inflow of the second air inlet.

* * * * *